United States Patent [19]

Dominguez

[11] Patent Number: 4,964,362

[45] Date of Patent: Oct. 23, 1990

[54] APPLICATOR FOR MOTOR VEHICLE GLASS ADHESIVES AND SEALANTS

[76] Inventor: Gilbert Dominguez, W310 S7772 Arbor Dr., Mukwonago, Wis. 53149

[21] Appl. No.: 283,785

[22] Filed: Dec. 13, 1988

[51] Int. Cl.[5] ..... B05C 1/02; B05C 9/06

[52] U.S. Cl. ..... 118/315; 118/324

[58] Field of Search ..... 264/45.1, 45.9, 46.4, 264/259, 177.1, 260; 425/4 C, 817 C, 113; 118/313, 314, 315, 324

[56] References Cited

U.S. PATENT DOCUMENTS

| | | | |
|---|---|---|---|
| 2,344,108 | 3/1944 | Roselund | 118/324 |
| 2,631,949 | 3/1953 | Kronthal | 118/315 |
| 3,884,183 | 5/1975 | Sprung | 118/324 |
| 4,527,510 | 7/1985 | Arndt | 118/324 |
| 4,821,673 | 4/1989 | Kirigakubo et al. | 118/324 |

*Primary Examiner*—Willard Hoag

*Attorney, Agent, or Firm*—C. Thomas Sylke; Arnold J. Ericsen

[57] ABSTRACT

A dual applicator for simultaneously applying a polyurethane adhesive and sealant and a foam dam to a motor vehicle window or windshield and a robot arm capable of translating and/or rotating the applicator relative to the glass. The applicator includes a first nozzle for discharging the polyurethane through a shaped opening which defines a first plane and a second nozzle adjacent to and offset from the first nozzle. The first nozzle discharges polyurethane in a first bead as the applicator or glass is translated and the second nozzle discharges the foamable material in a second bead adjacent to and spaced from the first bead.

14 Claims, 2 Drawing Sheets

APPLICATOR FOR MOTOR VEHICLE GLASS ADHESIVES AND SEALANTS

BACKGROUND OF THE INVENTION

This invention relates to applicators and more particularly to an applicator for simultaneously applying an adhesive and sealant in a first bead and a foamable material in a separate second bead to the periphery of glass to be installed in a motor vehicle.

In the manufacture of motor vehicles, such as automobiles and trucks, the front windshield and the rear window are commonly mounted by means of a sealant and adhesive material which maintains the glass article in position and provides a barrier against water. A polyurethane material is commonly employed for this purpose and is applied on the glass in a shaped bead after which the glass is inserted into a mating flange formed on the vehicle. As an additional sealant and for noise reduction, a second bead of a rubberlike foam material is applied interiorly of and adjacent to the first bead.

The polyurethane bead is applied and cured at substantially room temperature. On the other hand, the foam bead usually consists of a foamable hot melt wherein foaming is the result of a chemical reaction triggered by heat. For this reason, the foam bead is generally, applied at a temperature of about 300° F. Because the polyurethane bead must retain its shape for satisfactory application and since the material tends to flow at elevated temperatures, it was the common practice to apply the beads of polyurethane and the foamable material separately. Such separate applications necessitated the use of separate robot devices for applying the two materials and separate workstations for each. This had the obvious disadvantage of substantial capital costs and an increase in the manufacturing time.

SUMMARY OF THE INVENTION

It is an object of the invention to provide a new and improved method and apparatus for simultaneously applying a sealant adhesive and a foam dam to a glass article to be installed in a motor vehicle or the like.

Another object of the invention is to provide a method and apparatus for applying a sealant adhesive and a foam dam to a glass article to be installed in a motor vehicle or similar article which requires only a single workstation.

A further object of the invention is to provide a method and apparatus for applying a sealant adhesive and foam dam to a glass article to be installed in a motor vehicle or the like wherein the adhesive and sealant material are not affected by the heated foam dam material.

Yet another object of the invention is to provide a method and apparatus for applying a sealant adhesive and foam dam to a glass or similar article to be installed in a motor vehicle or the like wherein spacing between the materials can be closely controlled.

These and other objects and advantages in the present invention will become more apparent from the detailed description thereof taken with the accompanying drawings.

In general terms, the invention comprises a dual applicator for simultaneously applying a first bead of an adhesive and sealant and a second bead of a foam material to a glass article to be installed as a window or windshield in a motor vehicle, said applicator including a first nozzle for discharging the adhesive and sealant through a shaped opening onto one surface of the glass and a second nozzle disposed adjacent and offset from the first nozzle for discharging a foam material onto said surface adjacent to and spaced from the first bead, said first nozzle discharging a bead of sealant and adhesive as the applicator or glass are translated and the second nozzle discharging the foam material in a second bead adjacent to and uniformly spaced from the first bead.

BRIEF DESCRIPTION OF THE DRAWINGS

FIG. 1 schematically illustrates the system for simultaneously applying a sealant adhesive and foam dam to a glass article or the like;

DETAILED DESCRIPTION OF THE PREFERRED EMBODIMENT

Figure 1:
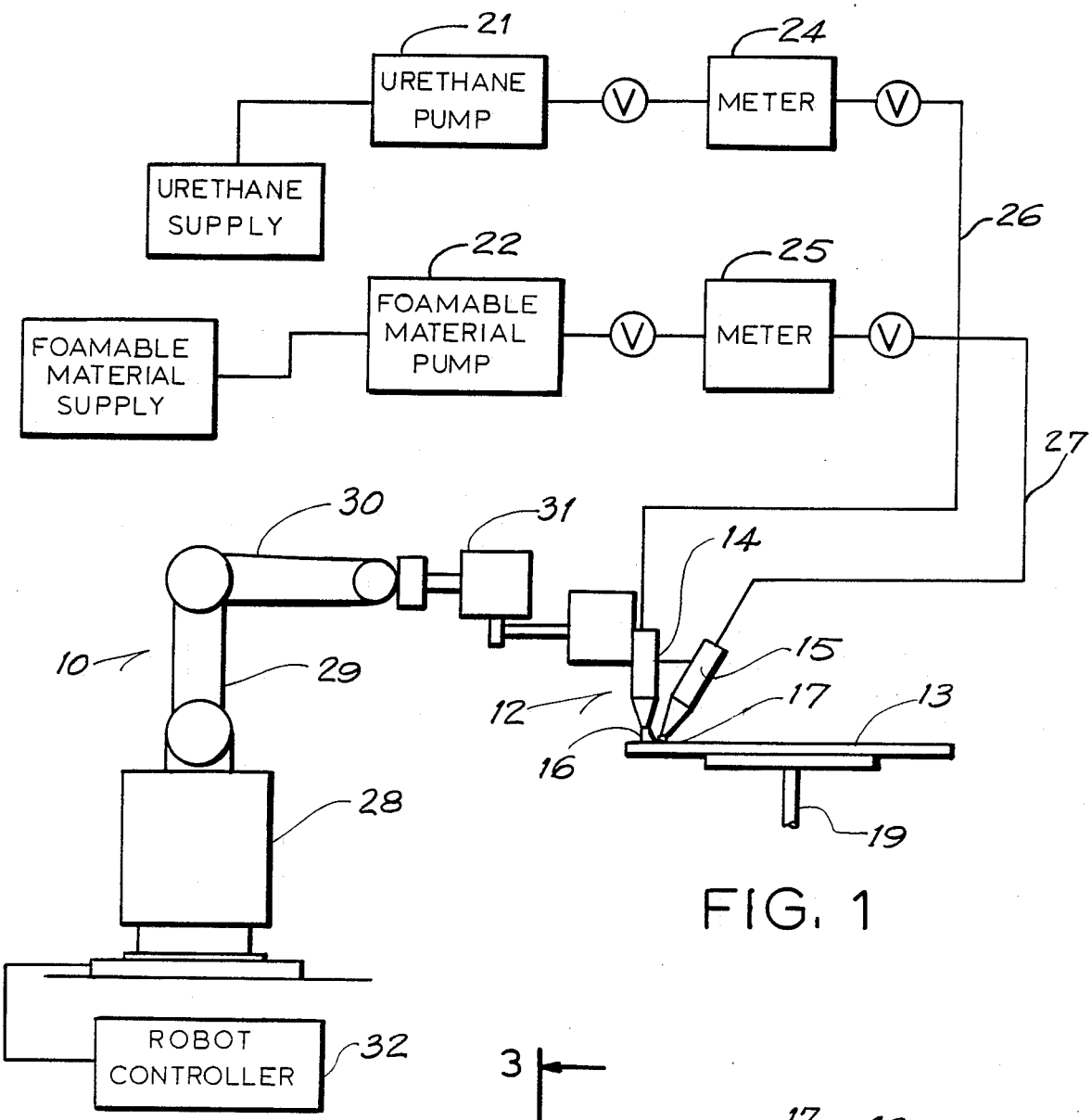

FIG. 1 schematically illustrates a system with which the applicator according to the preferred embodiment of the invention may be employed. The system of FIG. 1 includes a robot assembly 10 which is constructed and arranged to position an applicator assembly 12 relative to a glass article 13, such as a motor vehicle windshield or window. The applicator 12 includes a first dispenser 14 for an adhesive and sealant material, such as urethane, and a second dispenser 15 for a foamable material. Either the applicator 12 or the glass article 13 may be manipulated such that a first bead 16 of the adhesive and sealant and a second bead 17 of the foamable material will be simultaneously applied to the entire periphery of the glass article 13.

Figure 2:
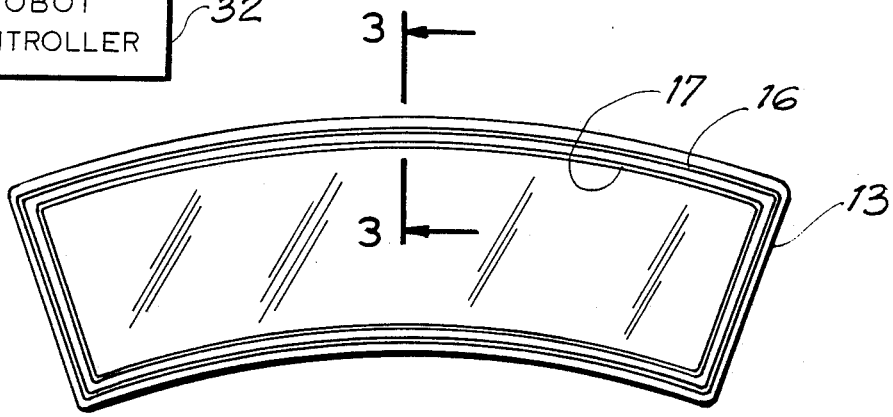
FIG. 2 shows the glass article to which the apparatus shown in FIG. 1 applies an adhesive and sealant and a foam dam.

While those skilled in the art will appreciate that either the applicator 12 or the glass article 13 may be moved and the other held in a fixed position, in the preferred embodiment of the invention, the glass article 13 is held in a fixed position by a fixture 19 while the applicator 12 is translated by the robot assembly 10. As seen in FIG. 2, the bead 17 of foam material is disposed inwardly on the adhesive and sealant bead 16 so that when the applicator 12 is positioned at a corner of the glass article 13, the dispenser 14 must be moved at a greater relative linear speed than the dispenser 15.

The supply system for the materials is schematically illustrated in FIG. 1 to include pumps 21 and 22 for the adhesive and sealant material and the foamable material, respectively. Such supply systems are well known in the art and, accordingly, will not be described in detail for the sake of brevity. It will be sufficient for purposes of understanding the invention to state that the outlet of each pump 21 and 22 is connected through a valve to a meter 24 and 25, respectively, which controls the flow rate of the materials. The outlet of meter 24 is connected to the dispenser 14 and the outlet of meter 25 is connected to the dispenser 15. While not illustrated in the drawing, those skilled in the art will appreciate that the foamable material must be dispensed at a temperature of about 300° F. Accordingly, the conduits 26 and 27 which interconnect the supply, the pump 22, the meter 25 and the dispenser 15 are preferably heated.

Robot 10 is schematically illustrated to include a base 28 which supports a first column 29 having an arm 30 extending from its upper end. The column 29 and arm 30 are bi-directionally pivotable in a manner well known in the art. At the remote end of the arm 30 is the remote axis motor 31 which is operative for rotating the dispenser assembly 12. While any well known robot arm assembly may be employed, one such device with which the applicator of the invention may be advantageously employed is ASEA Model No. IRB 90.

A computer or microprocessor 32 is coupled to the robot 10, the glass positioning assembly 19, and the meters 24 and 25 and their associated valves. Computer 32 is preprogrammed in a manner well known in the art to control the delivery of material to the dispenser 12 and the movements of the robot 10 and the glass positioning mechanism 19. This will insure proper feed rates and displacements so that the beads 16 and 17 will have the desired configurations and uniform cross-sectional configurations throughout. Since the computer 32 is of a type well known in the art, it will not be described further for the sake of brevity.

Figure 5:
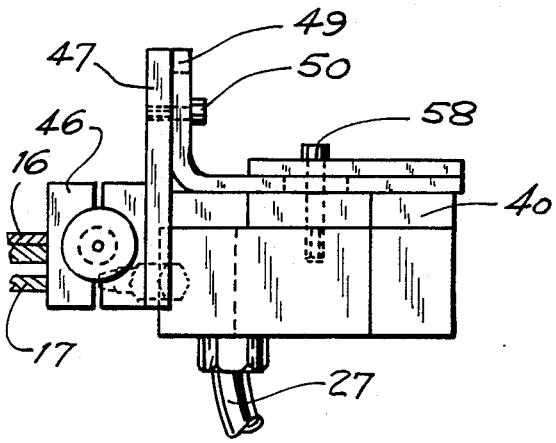
FIG. 5 is a top plan view of the applicator shown in FIG. 4.
Figure 4:
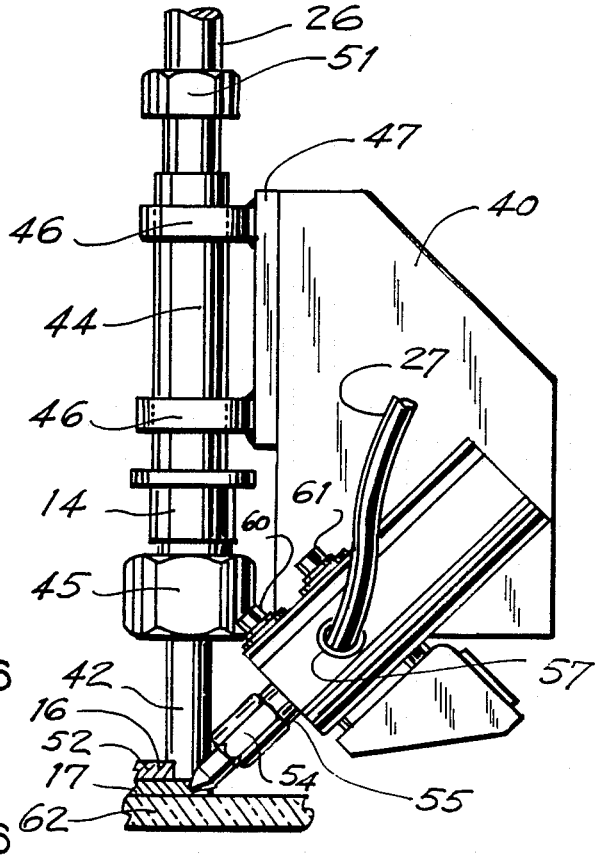
FIG. 4 is a side elevational view of the applicator used with the system shown in FIG. 1.

The applicator 12 according to the preferred embodiment of the invention is shown in FIGS. 4 and 5 to include a support plate 40 which supports the first and second dispensers 14 and 15. The dispenser 15 includes an elongate tubular nozzle 42 which is removably mounted within a sleeve 44 by a nut 45. The sleeve 44 is secured by clamps 46 to a plate 47 fixed to plate 40 which in turn is mounted at the end of robot arm 30 and is coupled to the remote axis motor 31. In particular, plate 47 is secured by bolts 50 to an L-shaped bracket 49 extending laterally from one side of plate 40. The upper end of the tubular nozzle 42 is coupled by a fitting 51 to the urethane supply pipe 26.

The second dispenser 15 includes a nozzle 52 which is secured by a nut 54 to a discharge pipe 55 extending from and communicating with a supply chamber 57. The chamber 57 is also secured by bolts 58 to the support plate 40 and is provided with a heat exchange jacket (not shown) which is coupled to a source of heated fluid by an inlet pipe 27 so that the foamable material can be maintained at the proper temperature.

Figure 6:
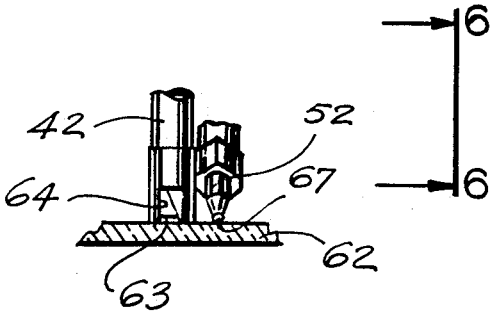
FIG. 6 is a view taken along lines 6—6 of FIG. 5.

As shown in FIGS. 4–6, the nozzle 42 is oriented generally perpendicularly to the glass 13 although it will be appreciated that the glass may not be planar. Nozzle 42 is open at its lower end 63 and there is a side discharge opening 64 which is trapezoidal and arranged such that the nonparallel sides are relatively longer than the parallel ends and the opening tapers inwardly from bottom to top. As illustrated, the bottom opening 63 is in substantial contact with and oriented generally parallel to the adjacent surface of the glass 13.

Figure 3:
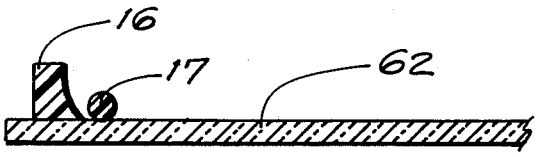
FIG. 3 is a view taken along lines 3—3 of FIG. 2.

The second nozzle 52 is shown to be disposed adjacent to and spaced from the nozzle 42 and oriented with the axis of its discharge opening 67 at an acute angle relative to the surface of the glass 13. As a result, the bead of foam material 17 is deposited on the glass 13 in spaced relation from the bead of urethane 16 as seen in FIGS. 3 and 5. This spacing is important so that heat from the foam material 17, which is at about 300° F. when deposited, will be transferred to the glass 13 and not the adhesive and sealant bead 16. Since the glass 13 represents a relatively large heat sink, little, if any, heat will be transferred from the bead 17 to the bead 16. As a result, the adhesive and sealant bead 17 will retain the desired shape as illustrated in FIG. 3.

In the preferred embodiment, the relative speed of travel of the glass 13 and the dispenser 12 is less than about 12 inches per second. In order to achieve uniform beads around the entire periphery of the glass 13, the relative speed of the dispenser 12 and the glass 13 should be constant and the meters 24 and 25 should deliver material at a constant flow rate. It is, possible that variable flows will be needed in higher dispensing speed range 5. However, when the dispenser moves through one of the corners of the glass 13, as shown in FIG. 2, the dispenser 12 will be pivoted about an axis centered in nozzle 42 and on the side thereof opposite the nozzle 52. In addition, there will be some translation of the dispenser 12 by the robot 10. It will be appreciated that the computer 32 will adjust the speed and acceleration of the nozzles 42 and 52 so that the bead shapes will remain uniform as the dispenser traverses the corners.

The foamable material 17 and the urethane adhesive and sealant 16 are well known in the automobile industry for securing and sealing windows and windshields. Accordingly, these materials need not be described in detail. It will be sufficient to understand the invention to state that the foamable hot melt material is a tacky, thermoplastic, elastomeric, rubberlike substance which upon being heated undergoes a chemical reaction causing the formulation of a foamlike material. While urethane is disclosed as the sealant and adhesive any suitable material may be employed.

While only a single embodiment of the invention has been illustrated and described, it is not intended to be limited thereby but only by the scope of the appended claims.

I claim:

1. Apparatus for simultaneously applying a first bead of a first adhesive and sealant material and a second bead of a second sealant material to a glass article to be installed as a window, said apparatus including a first nozzle means for discharging the first adhesive and sealant material through a shaped opening onto one surface of the glass and a second nozzle means disposed adjacent to and offset from said first nozzle means for discharging the second sealant material onto said surface adjacent to, spaced from and parallel to the first adhesive and sealant material, means for producing relative translation between the glass and said nozzles, said first nozzle means being suitable for discharging a bead of the first sealant and adhesive material as the nozzles or glass are translated and said second nozzle means being suitable for discharging the second sealant material in a second bead adjacent to, parallel to, and uniformly spaced from the first bead.

2. The dispenser set forth in claim 1 wherein the first nozzle means is generally tubular and oriented generally perpendicularly to the adjacent surface of the glass article, the lower end of said tube being open and a discharge opening being formed in said tube and the side thereof facing away from the travel direction, the lower end of the second nozzle means being disposed in alignment with and adjacent said first nozzle means.

3. The dispenser set forth in claim 2 wherein the second nozzle means is located adjacent the first nozzle means and spaced therefrom, the axis of a second nozzle means being oriented at an angle of about 45° relative to a plane containing the axis of the first nozzle means.

4. The dispenser set forth in claim 3 wherein the discharge opening in the first nozzle means being trapezoidal.

5. The applicator set forth in claim 1 wherein the first nozzle means has an opening oriented generally perpendicular to the surface and being generally rectangular.

6. The dispenser set forth in claim 5 wherein said opening is trapezoidal.

7. The dispenser set forth in claim 6 wherein the second nozzle means is located adjacent the first nozzle and spaced therefrom, the axis of a second nozzle means being oriented at an angle of about 45° relative to a plane containing the axis of the first nozzle means.

8. The dispenser set forth in claim 7 wherein the first nozzle means is generally tubular and oriented generally perpendicularly to the adjacent surface of the glass article, the lower end of said tube being open and a discharge opening being formed in said tube and the side thereof facing away from the travel direction, the lower end of the second nozzle means being disposed in alignment with and adjacent said first nozzle means.

9. A method of simultaneously applying a first bead of an adhesive and sealant and a second bead of a second sealant material around the periphery of a glass article to be installed as a window or windshield in a motor vehicle, the steps of discharging from a first nozzle the adhesive and sealant through a shaped opening onto one surface of the glass and adjacent the periphery thereof and simultaneously discharging a second sealant material from a second nozzle adjacent to and spaced from the first nozzle, translating the nozzles or glass while discharging the sealant and adhesive in a first bead on said surface and while simultaneously discharging the second sealant material from the second nozzle in a second bead adjacent to and uniformly spaced from the first bead whereby heat transfer between said beads is minimized.

10. In combination, a robot arm means and a dual applicator for simultaneously applying a first bead of an adhesive and sealant material and a second bead of a second sealant material to a glass article to be installed as a window or windshield in a motor vehicle, said robot arm being operative for translating and rotating said applicator, glass positioning means for positioning said glass adjacent said applicator, said applicator including a first nozzle for discharging the adhesive and sealant through a shaped opening onto the surface of the glass and a second nozzle disposed adjacent and offset from the first nozzle for discharging a second sealant material onto said surface adjacent to and spaced from the adhesive and sealant, one of said robot arm means and glass means being operative to translate said applicator or glass relative to the other so that said first nozzle being suitable to discharge a bead of sealant and adhesive and the second nozzle discharges the second sealant material in a second bead adjacent to and uniformly spaced from the first bead as the applicator or glass are translated, said beads being applied parallel to one another around the periphery of said glass article.

11. The dispenser set forth in claim 10 wherein the first nozzle is generally tubular and oriented gererally perpendicularly to the adjacent surface of the glass. article, the lower end of said tube being open and a discharge opening being formed in said tube and the side thereof facing away from the travel direction, the lower end of the second nozzle being disposed in alignment with and adjacent said first nozzle.

12. The applicator set forth in claim 10 wherein the first nozzle has an opening oriented generally perpendicular to the surface and being generally rectangular.

13. The dispenser set forth in claim 12 wherein said first nozzle opening is trapezoidal.

14. The dispenser set forth in claim 13 wherein the second nozzle is located adjacent the first nozzle and spaced therefrom, the axis of a second nozzle being oriented at an angle of about 45° relative to a plane containing the axis of the first nozzle.

* * * * *